US005332926A

United States Patent [19]

Ueno et al.

[11] Patent Number: 5,332,926

[45] Date of Patent: Jul. 26, 1994

[54] STARTER MOTOR ELECTROMAGNETIC SWITCH

[75] Inventors: Hirokazu Ueno; Hiroyuki Morikane, both of Himeji, Japan

[73] Assignee: Mitsubishi Denki Kabushiki Kaisha, Tokyo, Japan

[21] Appl. No.: 999,083

[22] Filed: Dec. 31, 1992

[30] Foreign Application Priority Data

Jan. 31, 1992 [JP] Japan ..... 4-045897

[51] Int. Cl.[5] ..... F02N 11/04

[52] U.S. Cl. ..... 307/10.6; 290/36 R; 290/38 R; 290/38 A

[58] Field of Search ..... 290/38 R, 36 R, 47, 290/48, 38 A; 307/10.6; 310/87, 88, 66, 69; 74/7 R, 7 A, 7 B, 7 C; 123/179.1, 179.3

[56] References Cited

U.S. PATENT DOCUMENTS 5,023,466 6/1991 Isozumi ..... 290/48

FOREIGN PATENT DOCUMENTS 2-3631 1/1990 Japan .

*Primary Examiner*—Brian K. Young
*Assistant Examiner*—Aditya Krishnan
*Attorney, Agent, or Firm*—Sughrue, Mion, Zinn, Macpeak and Seas

[57] ABSTRACT

A guide hole **16*b* is formed in the insulation cap 16 of a starter motor electromagnetic switch, and a coil terminal 30 inserted through the guide hole has one or more projections 30*b* formed at a location corresponding to the guide hole so that the projections are wedged against an inner surface of the hole, thus preventing any resonant vibrations of the terminal and the attendant severing of its attached lead wire 1*a***.

7 Claims, 2 Drawing Sheets

STARTER MOTOR ELECTROMAGNETIC SWITCH

BACKGROUND OF THE INVENTION

1. Field of the Invention

The present invention relates to a starter motor electromagnetic switch which is attached to a starter motor, and which when energized, turns a shift lever and closes contacts in a circuit for the starter motor.

2. Discussion of Background

In FIG. 4, there is shown a cross sectional view of a conventional electromagnetic switch in an axial direction. Reference numeral 1 designates an excitation coil which is wound on a bobbin 2. Reference numeral 3 designates a fixed core which receives one end of the bobbin 2. Reference numeral 4 designates a yoke which forms a casing and is used for fixing the fixed core 3. Reference numeral 5 designates a plunger which is supported in an inner circumferential portion of a front end part of the yoke 4 so as to be movable in an axial direction, and which is made of a magnetic material and forms a movable core. Reference numeral 6 designates a return spring for the plunger 5. Reference numeral 7 designates a sleeve bearing which is staked to be fixed in a front portion of the plunger 5. Reference numeral 8 designates a hook which has a rear half portion inserted in a hole of the plunger 5 so as to be movably supported in an axial direction, which is made of e.g. a plastic material, and which has a front end portion engaged with an upper end portion of a fulcrumed shift lever (not shown) to turn it. Reference numeral 9 designates a compression spring for urging the hook 8 in a backward direction.

Reference numeral 10 designates a rod which is supported in a central hole of the fixed core 3 to be movable in an axial direction. Reference numeral 11 designates an insulation supporter which is fitted on the rod 10. Reference numeral 12 designates a movable contact which is fitted on the insulation supporter 11, and which is held by a retaining ring 14 through an insulation washer 13. Reference numeral 15 designates a compression spring which exerts an urging force on the movable contact 12. Reference numeral 16 designates an insulation cap which is pressed on a rear end of the fixed core 3 and crimped together by the yoke 4. Reference numeral 17 designates a pair of fixed contacts (only one is shown) which are opposed to the movable contact 12, with which a terminal bolt 18 is formed as one piece to extend outward, and which are connected to cables for a battery and the starter motor. Reference numeral 19 designates a return spring for the rod 10.

Reference numeral 20 designates a coil terminal which is formed in a strip shape, which has an inner end portion connected to lead wires 1*a* from the excitation coil 1, which has the inner end portion passed, with a small gap, through a guide hole 16*b* formed in a narrow shape in the insulation cap 16, and which has an outer end portion extended into a surrounding body 16*a* of the insulation cap 16. Reference numeral 21 designates a rubber plug which is fitted on the coil terminal 20, and which is seated on the bottom of the surrounding body 16*a*. As shown in the plan view of FIG. 5, the coil terminal 20 has a pinching portion 20*a* formed therein, the lead wires 1*a* being connected to the pinching portion 20*a* by pinching and soldering.

A coupler which is used to make plug-in connection with the coil terminal 20 is shown in part in section in the front view of FIG. 6. The coupler is indicated by reference numeral 22. Reference numeral 23 designates a cap which is made of a rubber material or the like. Reference numeral 24 designates a female connector which is arranged in the cap 23, which make solderless connection with a connection wire 25 from a key switch and so on, and which has a contact hole 24*a* formed therein to make the plug-in connection with the coil terminal 20.

Now, the operation of the conventional electromagnetic switch will be explained. When the excitation coil 1 is energized, the plunger 5 is attracted towards the fixed core 3. As a result, the hook 8 is retracted to turn the shift lever. Then, plunger 5 presses the rod 10, and the movable contact 12 closes the paired fixed contacts 17, causing the starter motor to start rotating.

Although the conventional electromagnetic switch as mentioned above has the coil terminal 20 supported by inserting it to the rubber plug 21, the conventional electromagnetic switch involves a problem wherein when great vibration is given from the side of an engine, the presence of the gap between the coil terminal 20 and the guide hole 16*b* of the insulation cap 16 causes the coil terminal 20 to undergo resonant vibrations, and the lead wires 1*a* connected to the coil terminal can be vibrated and cut off.

SUMMARY OF THE INVENTION

It is an object of the present invention to solve the problem stated above, and provide an electromagnetic switch capable of restraining a coil terminal from making resonant vibrations to prevent a lead wire of an excitation coil from being cut off, thereby improving reliability.

The foregoing and other objects of the present invention have been attained by providing a starter motor electromagnetic switch comprising: an insulation cap for surrounding a contact portion, adapted to be fixed to one end of a yoke with an excitation coil housed therein; a guide hole formed in the insulation cap; a surrounding body provided to the insulation cap; a coil terminal inserted through the guide hole, having an inner end side connected to a lead wire from the excitation coil and an outer end side extended through the surrounding body; and a projection formed on the coil terminal at a location corresponding to the guide hole so that the projection is engaged with an inner surface of the guide hole.

The coil terminal is preferably in a plate form.

The coil terminal is elastically deformable so that the projection elastically fits into the guide hole.

It is preferable that the projection causes the guide hole to be plastically deformed so that the projection fits into the guide hole.

It is preferable that the projection shaves the guide hole to fit into the guide hole.

In accordance with the present invention, the presence of the projection can prevent the coil terminal from shaking in the guide hole of the insulation cap to restrain resonant vibrations, thereby eliminating the cut off of the lead wire.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
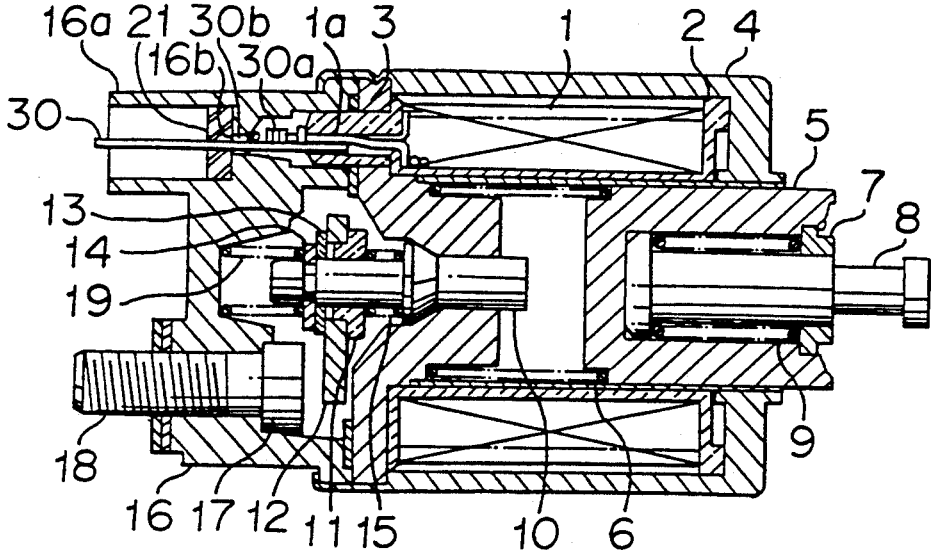
FIG. 1 is a cross sectional view of a first embodiment of the electromagnetic switch according to the present invention in an axial direction.
Figure 2A:
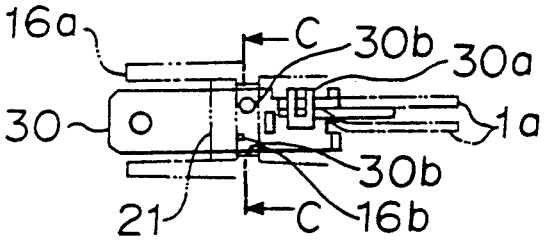
FIG. 2A is a plan view of the coil terminal shown in FIG. 1.
Figure 2C:
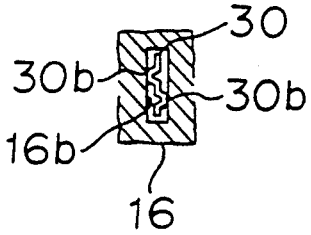
FIG. 2C is a cross section view taken substantially on line C—C of FIG. 2.
Figure 2B:
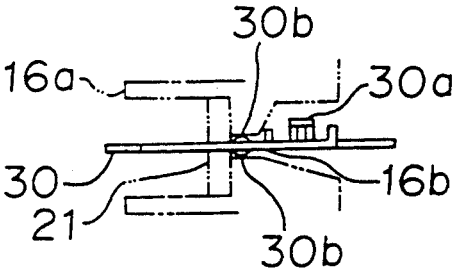
FIG. 2B is a side view of the coil terminal of FIG. 1.
Figure 4:
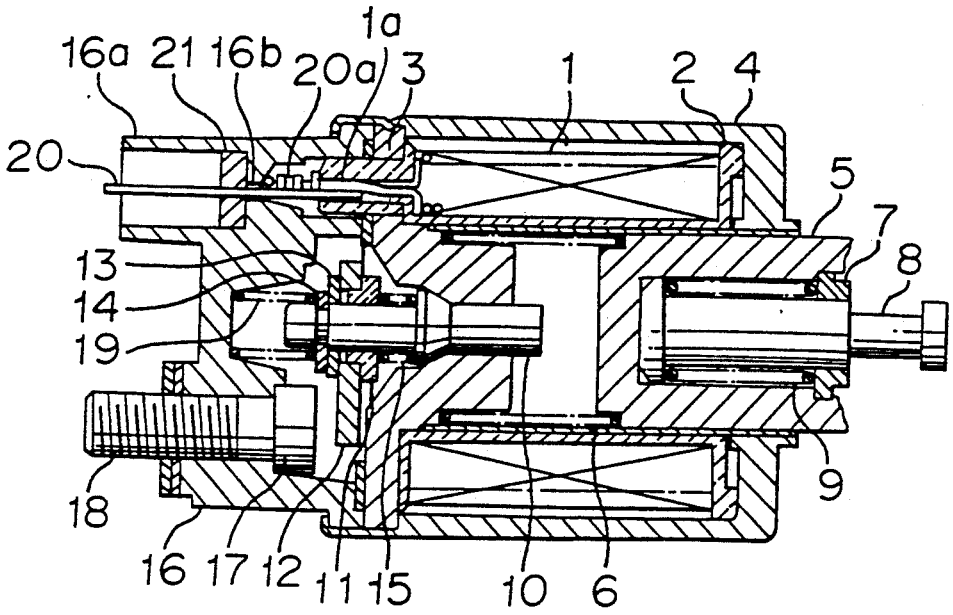
FIG. 4 is a cross sectional view of a conventional electromagnetic switch in an axial direction.
Figure 5:
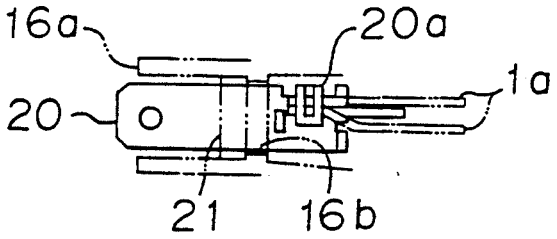
FIG. 5 is a plan view showing the coil terminal shown in FIG. 4.
Figure 6:
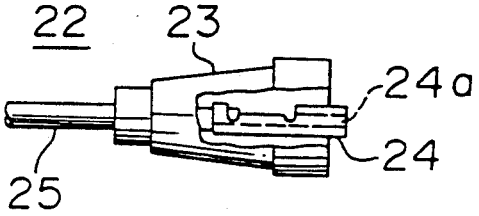
FIG. 6 is a side view showing a coupler partly in section, the coupler being used for make plug-in connection with the coil terminal in FIG. 4.

Referring now to the drawings, wherein like reference numerals designate identical or corresponding parts throughout the several views, and more particularly to FIG. 1 thereof, there is shown a cross sectional view of a first embodiment of the electromagnetic switch according to the present invention in an axial direction. Parts indicated by reference numerals 1–19, 21, 1*a*, 16*a* and 16*b* are similar or identical to those shown in FIG. 4. Reference numeral 30 designates a coil terminal which is made of a strip shape of a conductive material, and which is inserted through the guide hole 16*b* in the insulation cap 16. As shown in FIG. 2, the coil terminal 30 has a pinching portion 30*a* formed at an inner end side thereof for connecting the lead wires 1*a* by pinching and soldering. In addition, the coil terminal has projections 30*b* formed on the opposite surfaces thereof in its thickness direction at a location corresponding to the guide hole 16*b*. In FIGS. 2A and 2B, the coil terminal 30 is press-fit into the guide hole 16*b* from the right-hand side to the left-hand side. As a result, portions of the coil terminal 30 which are in proximity to the projections 30*b* are elastically deformed, and inner surface portions of the guide hole 16*b* which are engaged with the projections 30*b* are plastically deformed, thereby preventing the coil terminal from shaking. When the projections 30*b* are arranged on the opposite surfaces in an offset manner as shown in FIG. 2C, the elastic deformation can be easily obtained. The number of the projections 30*b* is determined from the viewpoint that the coil terminal 30 can be prevented from shaking in the guide hole 16*b*. The number is one or plural. The shape of the projection is not limited to a circular shape, and can have e.g. an elliptical shape.

Figure 3A:
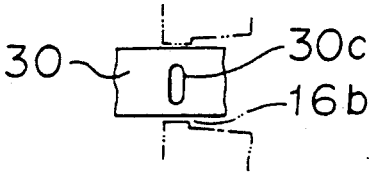
FIG. 3A is a plan view showing the essential portion of the coil terminal of a second embodiment according to the present invention.
Figure 3B:
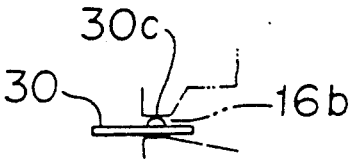
FIG. 3B is a side view showing the essential portion of the coil terminal of the second embodiment according to the present invention.

In FIG. 3, there is shown the coil terminal according to a second embodiment of the present invention. The coil terminal 30 has a projection or rib 30*c* formed in a generally shape on only one surface thereof. In this case, the inner surface of the guide hole 16*b* which is engaged with the projection 30*c* is mainly plastically deformed or is slightly shaved, allowing the projection 30*c* to be firmly engaged with the guide hole 16*b*.

Obviously, numerous modifications and variations of the present invention are possible in light of the above teachings. It is therefore to be understood that within the scope of the appended claims, the invention may be practiced otherwise than as specifically described herein.

What is claimed is:

1. A starter motor electromagnetic switch, comprising:

a) an excitation coil (1) wound around a bobbin (2), and having a lead wire (1*a*) extending axially outwardly from one end thereof, b) a yoke (4) surrounding the coil, c) an insulation cap (16) fixed to one end of the yoke, defining an outwardly extending sleeve member (16*a*) adapted to receive an inserted coupler (22), and having a guide hole (16*b*) formed therein, d) an elongate coil terminal (30) having an inner end attached to the lead wire, and a mid-portion extending through the guide hole such that an outer end is disposed within the sleeve for engagement by the coupler, and e) means for preventing resonant vibrations of the coil terminal and attendant severing or detachment of the lead wire, said preventing means comprising projection means (30*b*; 30*c*) upstanding from said mid-portion of the coil terminal a sufficient distance to engage an inner surface of the guide hole and to firmly wedge said coil terminal therein.

2. A starter motor electromagnetic switch according to claim 1, wherein the coil terminal is a flattened plate.

3. A starter motor electromagnetic switch according to claim 1, wherein the projection means causes the guide hole to be plastically deformed so that the projection mean, firmly fits into the guide hole.

4. A starter motor electromagnetic switch according to claim 2, wherein the coil terminal is elastically deformable so that the projection mean elastically firmly fits into the guide hole.

5. A starter motor electromagnetic switch according to claim 2, wherein the projection means comprises two projections (30*b*) individually upstanding from opposite sides of the plate.

6. A starter motor electromagnetic switch according to claim 5, wherein the two projections are laterally spaced.

7. A starter motor electromagnetic switch according to claim 2, wherein the projection means comprises a single, elongate, transversely oriented rib (30*c*) upstanding from one surface of the plate.

* * * * *